US005170951A

United States Patent [19]

Obitz

[11] Patent Number: 5,170,951

[45] Date of Patent: Dec. 15, 1992

[54] GRINDING APPARATUS

[76] Inventor: Stig Obitz, Blachebergsplan 7, 161 58 Bromma, Sweden

[21] Appl. No.: 681,359

[22] Filed: Apr. 8, 1991

[30] Foreign Application Priority Data

Apr. 9, 1990 [SE] Sweden ..... 9001294

[51] Int. Cl.[5] ..... B02C 7/12

[52] U.S. Cl. ..... 241/259.2; 241/260

[58] Field of Search ..... 241/261.1, 259.2, 260

[56] References Cited

U.S. PATENT DOCUMENTS

| | | | |
|---|---|---|---|
| 1,951,519 | 3/1934 | Milne | 241/259.2 |
| 2,087,556 | 7/1937 | Tolman | 241/259.2 |
| 3,708,130 | 1/1973 | Perry | 241/260 |
| 3,977,611 | 8/1976 | Stöbom | 241/251 |
| 4,986,480 | 1/1991 | Gullichsen et al. | 241/28 |
| 5,048,768 | 9/1991 | Bernhard et al. | 241/261.1 |

FOREIGN PATENT DOCUMENTS

| | | | |
|---|---|---|---|
| 1045929 | 10/1983 | U.S.S.R. | 241/260 |
| 1512653 | 10/1989 | U.S.S.R. | 241/260 |

*Primary Examiner*—Mark Rosenbaum
*Assistant Examiner*—John M. Husar
*Attorney, Agent, or Firm*—Dowell & Dowell

[57] ABSTRACT

A fibrous material grinding apparatus which includes a rotatable grinding device mounted within a housing about which is disposed a number of stationary grinding devices and which are selectively spaced and moveable with respect to the rotatable grinding device to vary a grinding gap therebetween and wherein the fibrous material is introduced into a channel which extends centrally around the periphery of the rotatable grinding device so as to distribute the fibrous material to the grinding gap spaces between the rotary and stationary grinding devices.

14 Claims, 7 Drawing Sheets

GRINDING APPARATUS

BACKGROUND OF THE INVENTION

The present invention relates to fibrous-material grinding apparatus of the kind which includes a housing which incorporates at least one material inlet and at least one material outlet, rotatable grinding device of substantially cylindrical configuration mounted in said housing, and a plurality of stationary grinding devices disposed around the rotatable grinding device and capable of being pressed towards the rotatable grinding device and which together form a grinding gap in which the fibre material is worked and transported from material inlet to material outlet as a result of rotation of the rotatable grinding device.

HISTORY OF THE RELATED ART

Known drum refiners of this kind include a plurality of grinding segments disposed around the rotatable grinding device. These grinding segments are mounted for movement in a radial direction towards the mantle surface of the rotatable grinding device and can be pressed axially against the rotatable grinding device by a respective hydraulic piston-cylinder device mounted behind each grinding segment. A large number of such grinding segments are provided, in order to cover the desired area of grinding surface on the mantle surface of the rotatable grinding device, and adjustment of the size of the grinding gap necessitates individual adjustment of each hydraulic piston-cylinder device acting on a grinding segment. This task is made highly complicated by the large number of grinding segments which need to be adjusted to essentially the same radial distance from the mantle surface of the rotatable grinding device.

SUMMARY OF THE INVENTION

The prime object of the present invention is to provide a grinding apparatus of the kind described in the introduction in which the extent to which the material is ground can be regulated in a simple and effective fashion as the rotatable grinding device rotates.

This and other objects are achieved with an inventive grinding apparatus having the characteristic features set forth in the following claims.

BRIEF DESCRIPTION OF THE DRAWINGS

The invention will now be described in more detail with reference to a preferred embodiment of the grinding apparatus and with reference to the accompanying drawings.

DESCRIPTION OF THE PREFERRED EMBODIMENT

Figure 2:
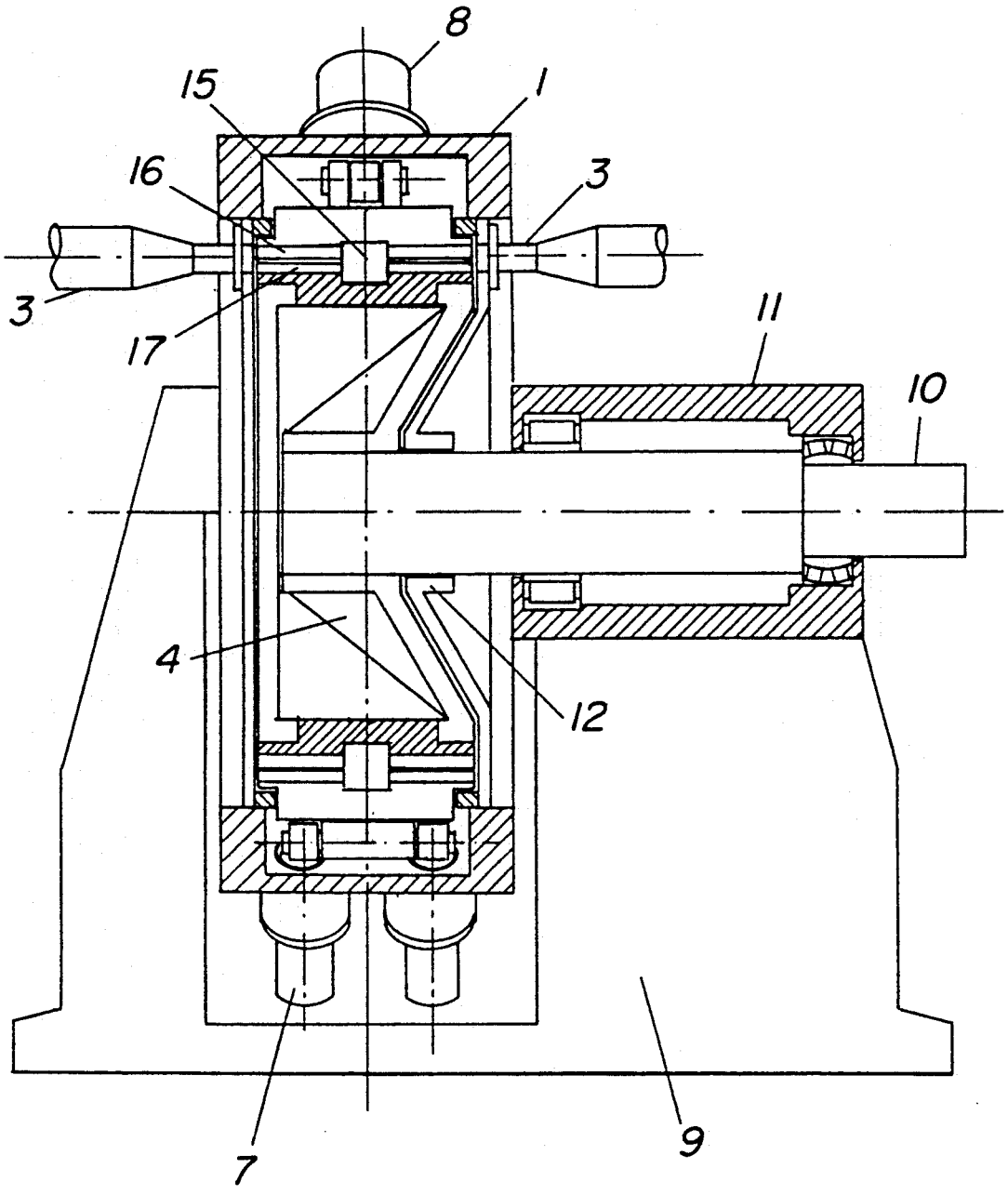
FIG. 2 is a corresponding longitudinal sectional view of the apparatus.

The illustrated grinding apparatus comprises a robust stand 9 which supports a drive motor (not shown) in a known manner and a shaft 10 which is connected to the drive motor and which is journalled in the stand 9 in a bearing unit 11 which includes a spherical and a cylindrical bearing. The apparatus housing 1 is supported on the left end of the stand 9, as seen in FIG. 2, by two bracket structures which are positioned centrally on the housing 1 and secured thereto with the aid of bolts, for example. The drive shaft 10 extends into the housing 1 via a water-cooled stuffing box 12 and carries at one end the rotatable grinding device or rotor 4, which is non-rotatably connected to the shaft. The mantle surface of the rotor 4 is configured with grinding surfaces which may have the form of a relief pattern or patterned grinding segments 17 such as to form a grinding surface which includes grooves and flutes in a technically known manner. The housing 1 is fitted with a sealing jacket 20 and O-rings, so as to prevent leakage between outlet and housing.

Disposed around the mantle surface of the rotatable grinding device or rotor 4 are a number of stationary grinding segments or flaps 5, which are curved with essentially the same radius of curvature as the cylindrical rotor 4 and which are located at a small distance from the rotor 4. The side of respective stationary grinding flaps which faces towards the mantle surface of the rotor is also provided with a patterned surface 16 of grooves and flutes which form a grinding surface. The flaps 5 are elongated and are pivotally journalled at one end to the housing 1 with the aid of journalling devices 7 and are journalled at the other end for movement towards and away from the mantle surface of the rotor 4, the movement being effected with the aid of pressing devices 8 in which the flaps or segments 5 are pivotally journalled with the aid of pivot shafts.

According to one preferred embodiment, the devices 7 by means of which the segments or flaps are pivotally journalled in the housing 1 preferably have the form of flap-adjusting devices which enable the flaps 5 at said one end to be adjusted radially towards and away from the mantle surface of the rotor 4, thereby enabling the grinding gap formed between the flap and the mantle surface of the rotor 4 to be adjusted to a basic setting.

In order to enable fibre material or other material to be worked in the grinding gap of the apparatus to be delivered to the gap, the apparatus includes a material inlet 2 which communicates with a central channel 15 surrounding the rotor 4.

The fibre material is dogged or otherwise entrained to the material outlets 3 by rotation of the rotor 4, as shown in FIG. 2, while being worked between the flaps and the mantle surface of the rotor 4, the material leaving the apparatus through outlets 3. Although the illustrated embodiment is shown to have four grinding flaps or segments, which cover the major part of the mantle surface of the rotor 4, it will be understood that the number of stationary grinding segments or flaps 5 can be varied without departing from the inventive concept. Several material inlets 2 and material outlets 3 may also be provided at different locations along the periphery of the housing 1 and the rotor 4.

In operation, the fibre material to be ground, such as lignocellulosic material, is fed through the inlet 2 to the grinding gap between the flaps 5 and the rotor 4 and accompanies rotation of the rotor while being worked between the respective patterned grinding surfaces of the rotor 4 and of the flaps 5, whereafter the ground material exits from the apparatus through the outlet 3. The basic setting of the grinding gap in the various grinding zones of the apparatus formed between respective flaps 5 and the rotor 4 is effected with the aid of the adjusting devices 7 and the size of the grinding gap is thereafter adjusted with the aid of the pressing devices 8. As the fibre suspension passes through the grinding apparatus, the degree of grinding, i.e. the absorption of energy; is adjusted in the described manner through the separate pressing devices 8 which are adjusted by means of control devices not shown. The pressure generated from the pulp as it is ground is taken-up by the front bearing in the stand 9. In operation, the fibre material passes through the input conduit 2, which is connected to a resilient pad 13 and connected directly to adjustable grinding devices. The fibre material is then transported from the inlet opening 14 and through a center channel 15 which distributes the material to the segments 16, 17, which work the fibre material in an axial direction and the material flows through the grooves 18, 19 to the material outlets 3. The fibre material can be repeatedly recycled and reworked, by connecting the outlet 3 in series with, for instance, the inlet to a following flap while, at the same time, ensuring that an axially movable partition wall or baffle 6 is in its lower or inwardly located position.

Figure 1:
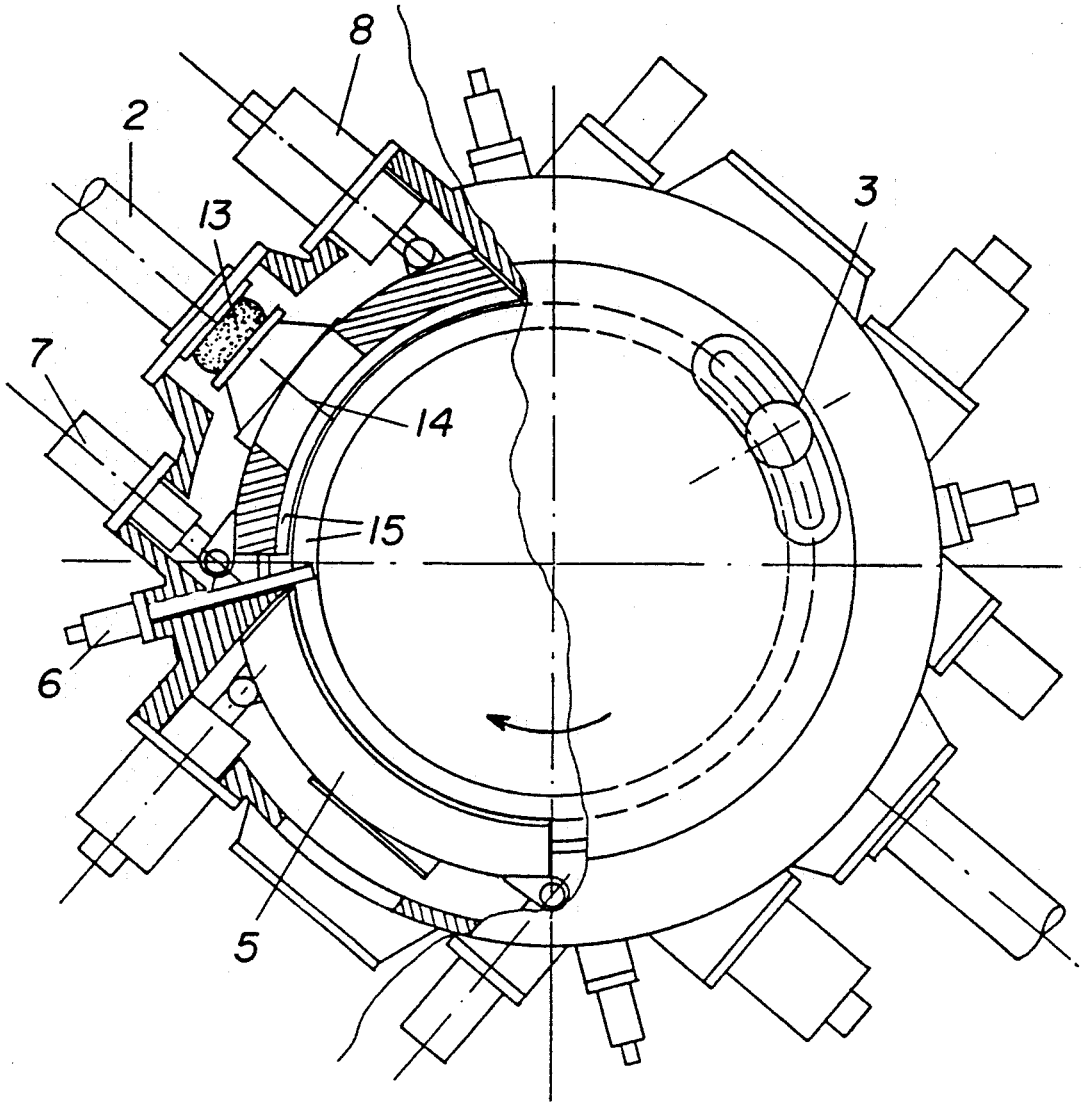
FIG. 1 is a cross-sectional view of the inventive grinding apparatus.
Figure 3:
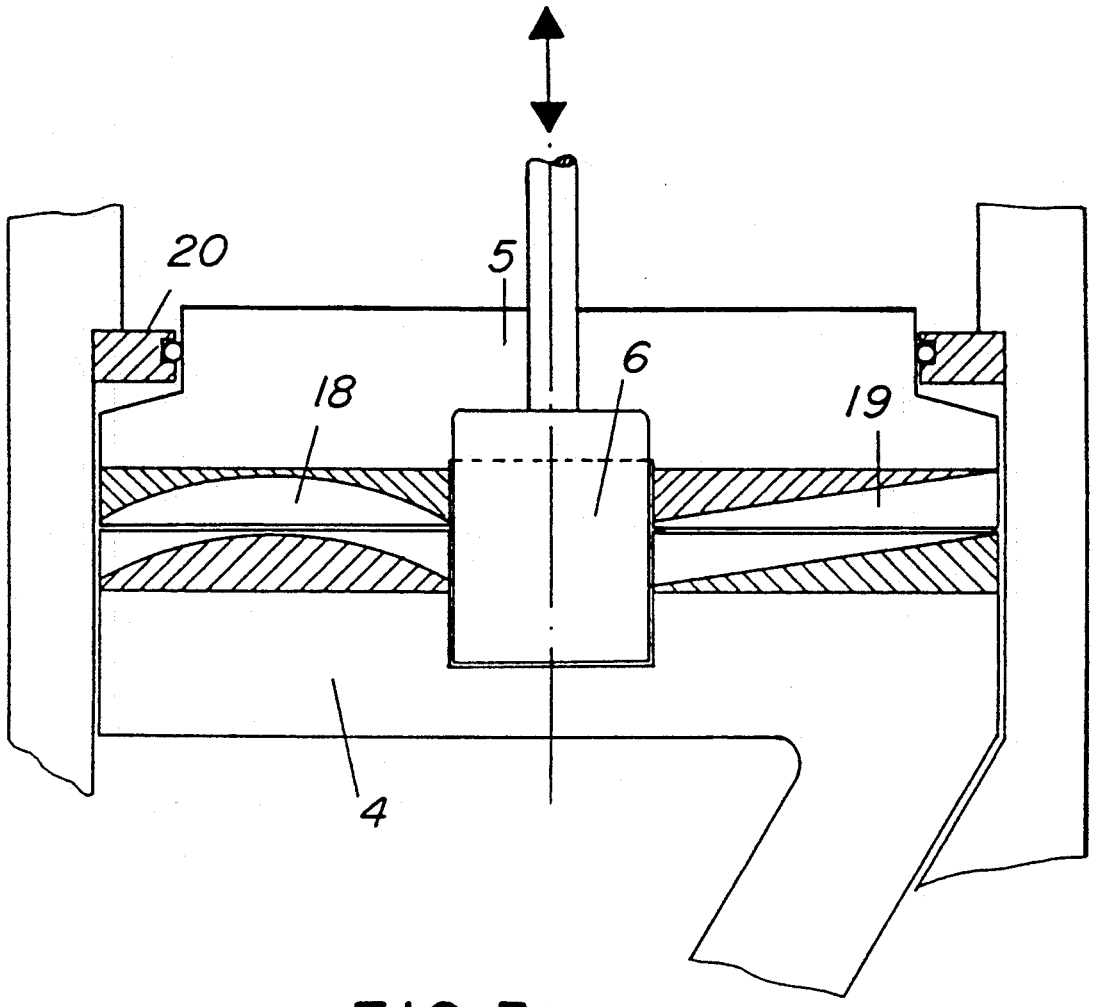
FIGS. 3 and 4 are respective cross-sectional views of grinding segments and adjustable channel walls.
Figure 4:
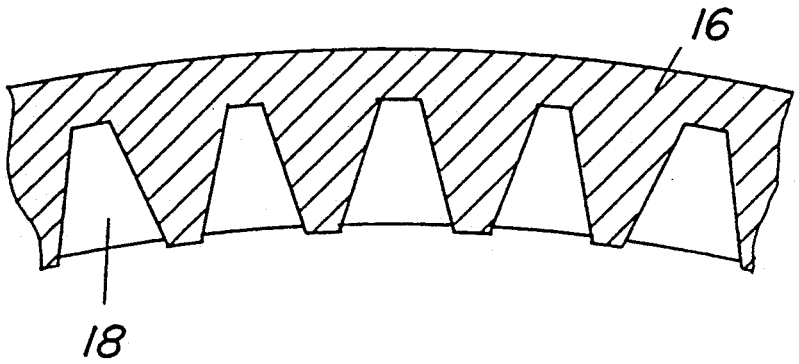

As before described, the fibre material passes through the inlet 2, the opening 14 and into the center channel 15 which surrounds the rotor and a part of which lies in the rotor and a further part lies in the stator (FIG. 1). The center channel 15 which distributes the fibre material around the rotor is divided into sections by the displaceable partition walls or baffles 6 which project down into the center channel 15 (FIG. 3) and which can be positioned so as either to throttle the flow of fibre material in the channel or to completely cut-off the flow. In the case of the illustrated embodiment, the flow of fibre material is caused to pass through a plurality of grooves or flutes which are either curved, such as the grooves 18 in FIG. 3, or angled, such as the grooves 19 in FIG. 3, so that the fibre material will pass through the grinding gap at least once with respect to the grooves 19 and at least twice in respect of the grooves 18. The fibre material will therewith flow from the center channel 15 towards both sides of the rotor and to the outlet 3 which extends along the curved path of the grinding gap. As illustrated in FIG. 1, the position of the outlet 3 can be varied so as to discharge ground material from the apparatus at an earlier or at a later stage. Outlets 3 can be provided for all grinding zones and, as before mentioned, the grinding zones can be connected in series so as to enable the fibre material to be worked several times, or can be connected in parallel for removal of ground material from the apparatus for further treatment.

Figure 5:
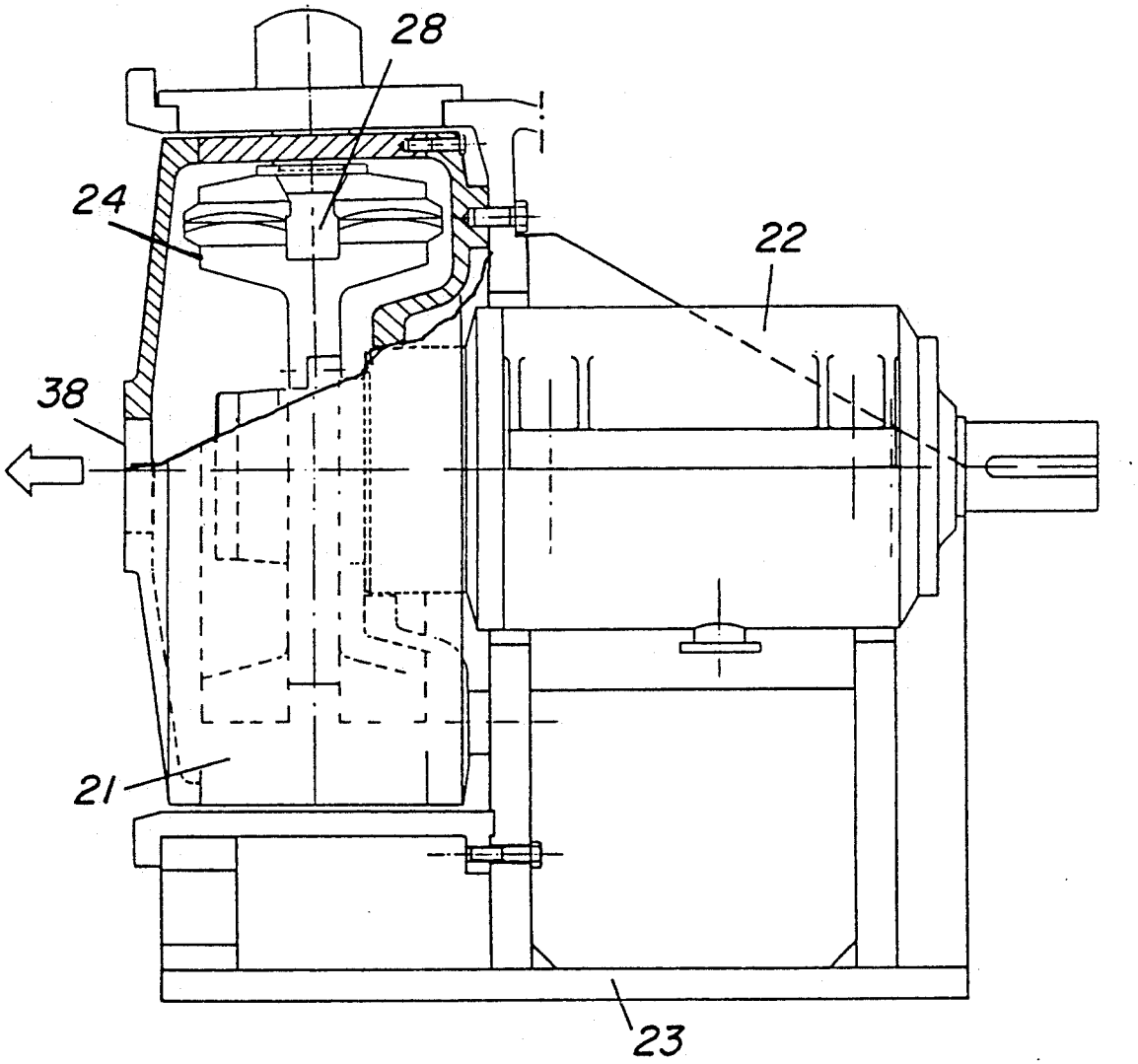
Figure 6:
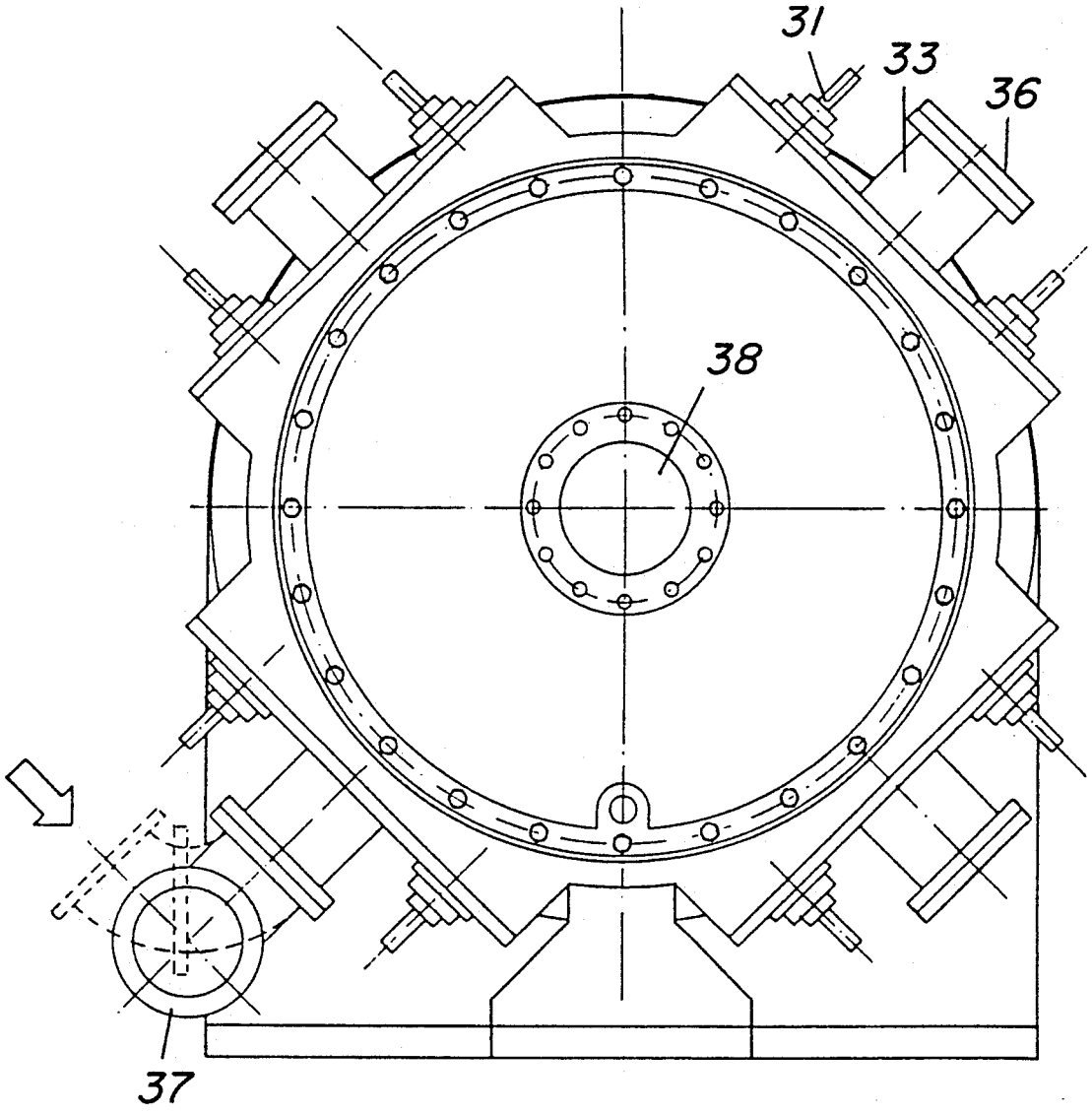
FIG. 6 is a view of the grinding apparatus shown in FIG. 5 as seen from the left.
Figure 7:
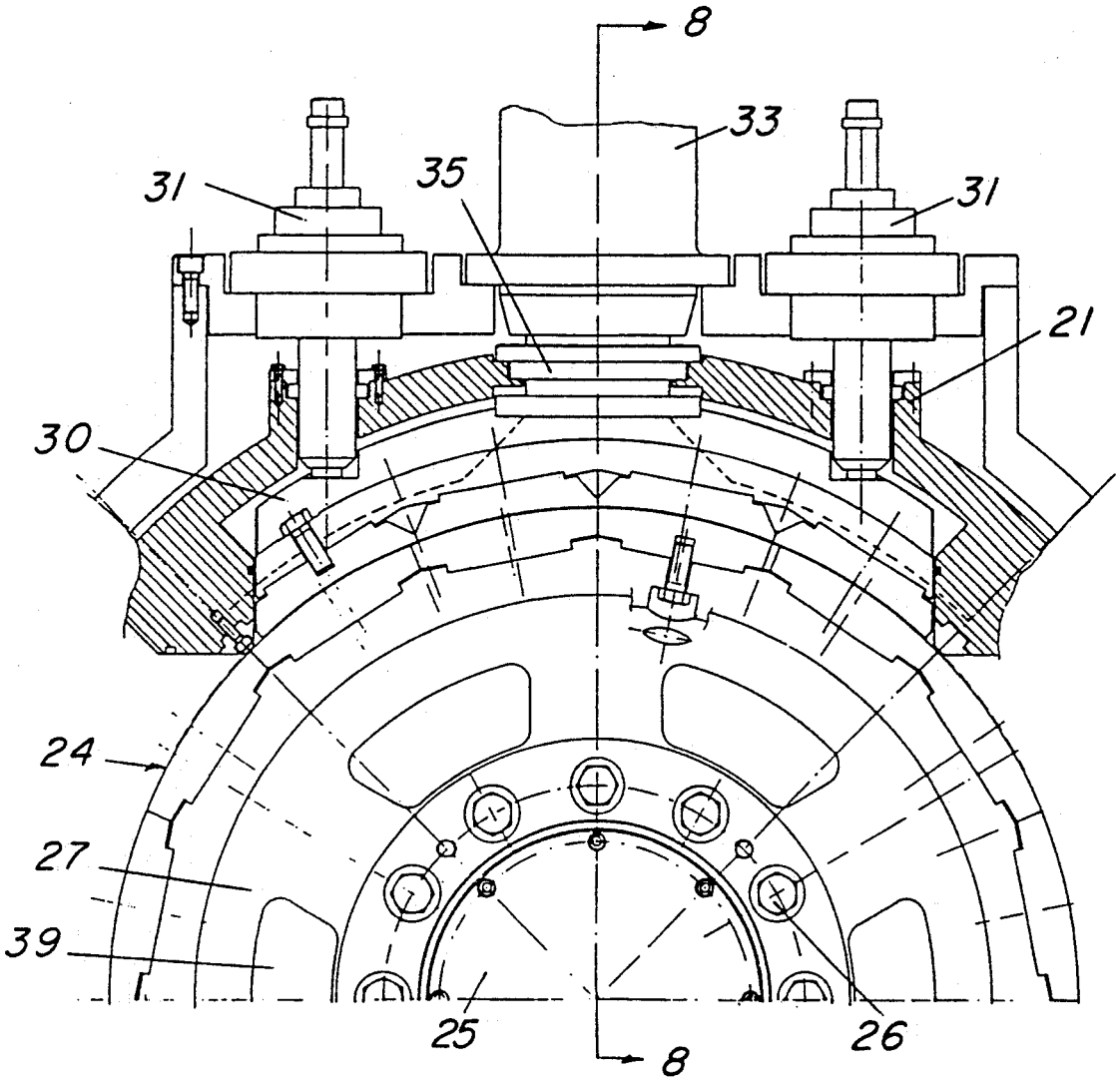
FIG. 7 is an enlarged sectioned view of the housing and one of the stationary grinding devices in the apparatus illustrated in FIGS. 5 and 6.
Figure 8:
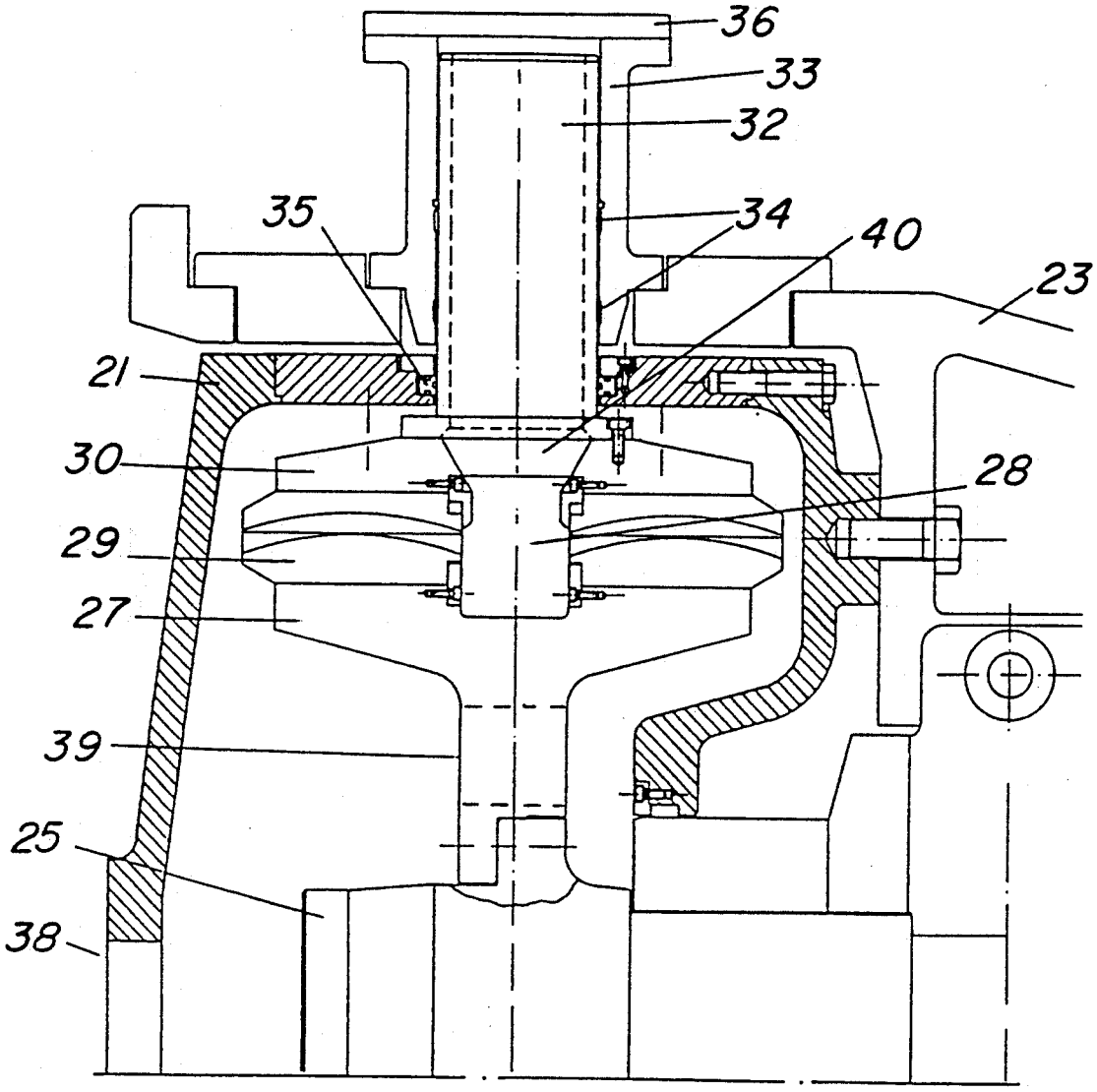
FIG. 8 is a sectional view taken on the line VIII—VIII in FIG. 7.

FIGS. 5–8 illustrate a modified form of the inventive grinding apparatus As shown in FIG. 5, the housing 21 and the bearing house 22 are carried by a stand 23. The rotatable grinding device or rotor 24 is mounted in the housing and connected non-rotatably to the shaft of the bearing house. In this embodiment, the rotor 4 includes a hub 25 to which there is connected by means of bolts 26 (FIG. 7) a rotor ring 27 provided with a center channel 28. Connected to the rotor ring 27 are stationary grinding segments 29, which extend around the mantle surface of said ring (FIGS. 7 and 8).

Similar to the embodiment illustrated in FIGS. 1–4, stationary grinding segments 30 are arranged around the mantle surface of the rotor and terminate short of the rotor surface so as to define a grinding gap therewith. The grinding segments 30 of this embodiment are elongated but, distinct from the earlier described embodiment, are not pivotally mounted but are instead radially movable in one piece towards and away from the mantle surface of the rotor 24. This movement is produced with the aid of the pressing device 31, which acts on abutment surfaces on the grinding-segment body 30. The grinding-segment body 30 is guided by a piston 32 connected to the body, the piston in turn being guided in a cylinder 33 by means of piston rings 34. A sealing annulus 35 is mounted between the piston 32 and the housing 21, to prevent the ingress of grinding material past the piston 32.

The embodiment illustrated in FIGS. 5–8 includes four stationary grinding segments 30 which coact with four cylinders 33, all of which are provided with a sealing cover 36 with the exception of the cylinder 33 shown furthest to the left in FIG. 6, this latter piston being connected to a grinding material inlet 37. The piston 32 is a hollow piston through which grinding material is delivered to the center channel 28 in the rotor 24, the material passing from the inlet 37, through the cylinder 33 and the piston 32 via an opening 40 in the stationary grinding device (FIG. 8) and to the channel 28 formed in the rotor 24. As illustrated in FIG. 6, the inlet 37 may be arranged at any desired angle in relation to the cylinder 33.

The embodiment described with reference to FIGS. 5–8 includes one single, centrally located outlet 38 which lies on the side of the apparatus remote from the bearing house 22. The grinding segments 29, 30 are located in that part of the housing 21 which faces towards the drive motor 22, and in order to enable grinding material, which leaves the rotor through said grinding segments, to flow to the central outlet 38, the rotor disc 27 is provided with a plurality of openings 39 around the disc periphery, through which the ultimately ground material can pass to that side of the rotor 24 which faces towards the outlet 38.

Apart from those differences concerning the manner in which the grinding segments 30 are guided and the arrangement of inlets 37 and outlets 38, the method of operation of the embodiment illustrated in FIGS. 5–8 is the same as that of the grinding apparatus described with reference to FIGS. 1–4. Thus, the material to be ground passes from the inlet 37, the piston 32, the opening 40 in the stationary grinding device 30, to the center channel 28 in the rotor 24, from where the material is distributed in the grinding gap between the grinding segments 29, 30, where the material is worked and then leaves the gap on both sides of the rotor. The ground material then flows to the outlet 38 either directly, or alternatively through the openings 39 in the rotor 24.

It will be understood that the described and illustrated embodiment can be modified and changed within the scope of the following claims and that the invention is not restricted to this embodiment.

I claim:

1. A fibrous material grinding apparatus comprising, a housing having at least one material inlet and at least one material outlet, a substantially cylindrical rotatable grinding device mounted in said housing, a plurality of stationary grinding devices disposed around said rotatable grinding device, means for pressing said stationary grinding devices toward said rotatable grinding device, a grinding gap defined between said stationary grinding devices and said rotatable grinding device in which the fibrous material is worked during rotation of said rotatable grinding device, a central channel surrounding said rotatable grinding device and intermediate the width of said grinding gap, said channel having a first portion formed in said rotatable grinding device and second portion formed in said stationary grinding devices, at least one of said stationary grinding devices having an opening through which the fibrous material is fed to said channel, said channel functioning to distribute the fibrous material around the periphery of said rotatable grinding device and into said grinding gap located between said channel and said material outlet.

2. The grinding apparatus of claim 1 including at least one baffle means, and means for selectively extending said baffle means into said channel to throttle the flow of fibrous material therein and to regulate the recycling of flow of fibrous material through said grinding gap.

3. The grinding apparatus of claim 2 in which said stationary grinding devices have first and second ends, journal means connected to said first ends to permit said stationary grinding devices to be adjusted radially with respect to said rotatable grinding device to thereby adjust said grinding gap therebetween.

4. The grinding apparatus of claim 3 including two parallel journal means connected to said first end of said stationary grinding devices.

5. The grinding apparatus of claim 3 in which said material outlet extends along the grinding gap and is selectively adjustable with respect thereto.

6. The grinding apparatus of claim 3 in which said rotatable grinding device and said stationary grinding devices have opposing grooves formed therein, said grooves being curved so as to cause the fibrous material to pass at least once through said grinding gap.

7. The grinding apparatus of claim 3 wherein said grooves formed in said rotatable grinding devices and said stationary grinding device are angled so as to force the fibrous material to pass twice through said grinding gap.

8. The grinding apparatus of claim 3 including material outlets arranged on opposite sides of said housing whereby fibrous material flow from said channel is towards both of said material outlets.

9. The grinding apparatus of claim 2 including journal means for radially moving said stationary grinding device with respect to said rotatable grinding device, piston means attached to said stationary grinding device, said piston means being extendable in cylinders mounted to said housing and seal means disposed between said piston means and said housing.

10. The grinding apparatus of claim 9 including material outlets disposed on opposite sides of said housing so that the fibrous material will flow from said channel towards said outlets.

11. The grinding apparatus of claim 9 wherein said rotatable grinding device and said stationary grinding devices have opposing grooves formed therein, said opposing grooves being curved so as to direct the fibrous material to pass between the grinding gap at least once.

12. The grinding apparatus of claim 9 wherein said grooves in said rotatable grinding device and said stationary grinding devices are angled so as to force the fibrous material to pass through said grinding gap twice.

13. The grinding apparatus of claim 2 in which said rotatable grinding device and said stationary grinding devices have opposing grooves formed therein, said grooves being curved so as to cause the fibrous material to pass through the grinding gap at least once.

14. The grinding apparatus of claim 2 in which said grooves in said rotatable grinding device and said stationary grinding devices are angled so as to cause the fibrous material to pass through said grinding gap twice.

* * * * *